United States Patent [19]

Richert

[11] Patent Number: 4,947,752

[45] Date of Patent: Aug. 14, 1990

[54] AMMUNITION FOR PROPELLING LOW PRESSURE, LOW WEIGHT BULKY PROJECTILES

[75] Inventor: Pierre Richert, Montigny Les Metz, France

[73] Assignee: Verney Carron, France

[21] Appl. No.: 336,248

[22] Filed: Apr. 11, 1989

[30] Foreign Application Priority Data

Apr. 13, 1988 [FR] France ..... 88 05255

[51] Int. Cl.[5] ..... F42B 5/02

[52] U.S. Cl. ..... 102/430; 102/439; 102/444; 102/447; 102/522

[58] Field of Search ..... 102/430, 439, 444, 446, 102/447, 466, 467, 502, 513, 520, 521, 522, 532

[56] References Cited

U.S. PATENT DOCUMENTS

| | | | |
|---|---|---|---|
| 3,088,405 | 5/1963 | Clark, Jr. | 102/466 |
| 3,164,092 | 1/1965 | Reed et al. | 102/522 |
| 3,334,588 | 8/1967 | Larsen | 102/439 |
| 3,732,820 | 5/1973 | Hendricks | 102/466 |
| 3,771,451 | 11/1973 | Woodring | 102/522 |
| 3,911,824 | 10/1975 | Barr et al. | 102/439 |
| 3,983,817 | 10/1976 | Tucker | 102/439 |

FOREIGN PATENT DOCUMENTS 2585818 2/1987 France .

OTHER PUBLICATIONS

Military Explosives, Dept. of Army Tech. Manual TM 9-1910, Apr. 1955, pp. 127-135, 128.

*Primary Examiner*—Harold J. Tudor
*Attorney, Agent, or Firm*—Steele, Gould & Fried

[57] ABSTRACT

The ammunition features a chamber (1*b*) having substantially along its full length a constant and uniform internal diameter corresponding to the diameter of a cartridge (2), in order to avoid building up high pressure, the said cartridge (2) being filled with pyroxylin powder and fitted with a primer (3) overcharged with a fulminating compound.

8 Claims, 1 Drawing Sheet

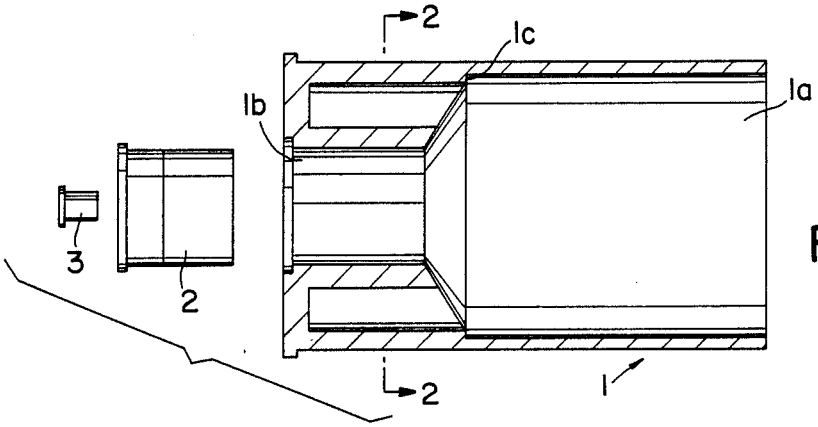
FIG.1
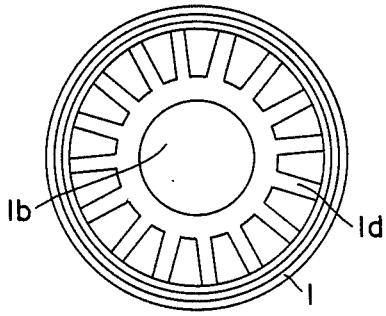
FIG.2
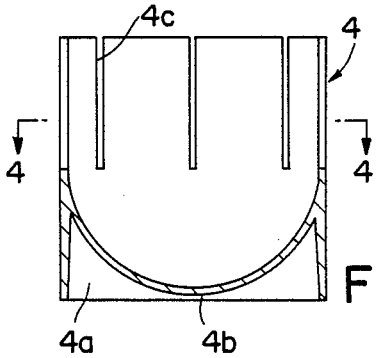
FIG.3
FIG.4
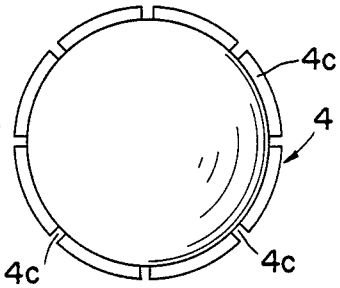
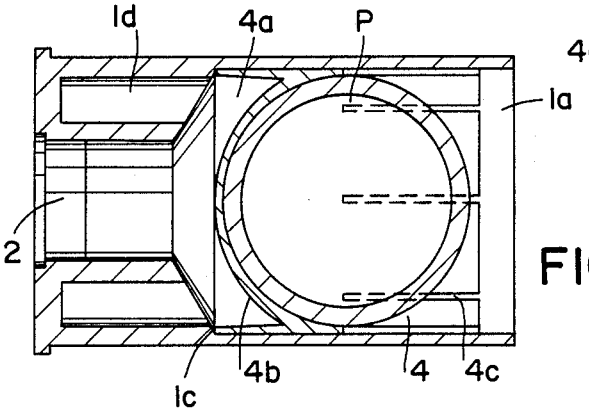
FIG.5

AMMUNITION FOR PROPELLING LOW PRESSURE, LOW WEIGHT BULKY PROJECTILES

The object of the invention is related to the technical ammunition field.

Ammunition for large gauge firearms designed for firing projectiles made from a supple material or consisting of a supple shell containing a liquid is known. The fragility of these projectiles is incompatible with propelling systems based on high pressure pyrotechny. This applies to mortars and grenade launchers which fire heavy charges.

Propulsion of bulky and light charges requires low pressure internal ballistics. In fact, energy is in direct relationship with the surface submitted to the thrust from the powder combustion gases. In this respect, only black powder offers a brisk and thorough combustion range under comparatively low pressure.

However, the use of black powder generates abundant smoke and a large amount of residue.

The invention is aimed at remedying these disadvantages in a simple, efficient and rational way.

In order to solve the problem consisting of obtaining a low pressure pyrotechnical system, without using a black powder charge, ammunition of the type including a cylindrical shell, one end of which can take at least one projectile, was designed and developed according to the invention, whereas the other end is provided with a concentric chamber designed to take a small size cartridge.

The concentric chamber has substantially along its full length a constant and uniform internal diameter corresponding to the cartridge diameter. In order to avoid building up high pressure, the said cartridge is filled with pyroxylin powder and fitted with a primer overcharged with a fulminating compound.

In order to solve the problem of protecting the projectile(s) against pressures or erosions, the projectiles are contained in a cup shaped element mounted with a sliding fit and centered in the bore of the corresponding part of the shell and applied in combination with an arrangement of the said bore against the top of the cartridge chamber.

Advantageously, the arrangement is a shoulder.

The rear of the cup has a skirt for sealing and positioning the shoulder in the shell bore.

The bottom of the cup is convex in order to withstand without deformation the gas flow streaming out of the chamber and to favour its distribution.

The edges of the cup rear skirt, from the convex bottom are designed with a decreasing thickness up to the free end.

The front part of the cup features slots which are regularly distributed over a periphery in order to facilitate the opening of the said part at the outlet of the case under the air pressure.

The present invention will become apparent from the accompanying drawings in which:

FIG. 1 is a cross-sectional longitudinal view of the shell before introduction of the cartridge.

FIG. 2 is a cross-sectional view taken through FIG. 1, along the line 2—2

FIG. 3 is a cross section of the cup

FIG. 4 is a cross-sectional view taken through FIG. 3, along the line 4—4.

FIG. 5 is a cross-sectional longitudinal view of the ammunition assembly with projectile positioned inside the cup.

For a better understanding of the invention, it is now described in a non-limitative way with reference to the examples of embodiments in the figures of the drawings:

The ammunition consists of a cylindrical plastic shell (1), one end of which (1*a*) can take at least one projectile (P), whereas the other end is designed with a concentric chamber (1*b*) which can take a small size cartridge (2). The chamber (1*b*) has substantially along its full length a constant and uniform internal diameter corresponding to the diameter of the cartridge (2). Therefore there is no necking at the chamber outlet which avoids a build up of high pressure and allows a reduction in the difference between the primary pressure in the cartridge (2) housed in the chamber (1*b*) and the secondary pressure in the free volume of the shell (1) containing the projectile.

The cartridge (2) is charged with a pyroxylin powder and is fitted with a primer (3) overcharged with a fulminating compound. Therefore, the charge of pyroxylin powder is fully and instantly ignited by a more powerful ignition of the reinforced primer.

As shown in FIGS. 3, 4 and 5 the projectile(s) are contained in a cup shaped element (4) mounted with a sliding fit and centered in the bore (1*a*) of the corresponding part of the shell (1). This cup (4) is applied against a shoulder (1*c*) formed above the chamber taking the cartridge (2). The rear part of the cup (4) features a skirt (4*a*) for sealing and positioning the shell in the bore against the shoulder (1*c*). The bottom (4*b*) of the cup (4) is convex in order to withstand without deformation the gas flow streaming out of the chamber and to favour its distribution.

The edges of the rear skirt (4*a*) of the cup (4), from the convex bottom (4*b*) are designed with a decreasing thickness up to the free end, in order to distribute the pressure of the gas column without pushing the cup and its content home.

The front part of the cup (4) features slots (4*c*) which are regularly distributed over a periphery in order to facilitate the opening of the said part at the outlet of the case under the air pressure. The cup (3) is made from a plastic material.

The projectile(s) (P) can be made from solid bodies of supple material or composed of supple shells containing a liquid.

In a preferred embodiment, the ammunition, such as described, uses a projectile (P) with the shape of a spherical bullet made from a deformable supple material.

As shown in FIG. 2, the external peripheral edge of the chamber (1*b*) and the corresponding part of the bore of the shell (1) particularly up to the shoulder (1*c*) are braced by radial fins (1*d*).

The advantages are readily apparent from the description, particularly it is underlined and reminded that the special primer is overcharged with a fulminating compound which allows optimal powder combustion despite a low primary pressure inside the propelling cartridge and secondary pressure when gases escape into the free volume of the main shell. The ammunition according to the invention uses a charge of pyroxylin powder without high pressure.

The invention provides a particular advantage for the propulsion of large diameter supple projectiles especially used for self-defence.

For information, the ammunition such as described and illustrated can advantageously be used in a weapon of the type described in the Patent Application No. 2,585,818.

I claim:

1. Ammunition comprising:

a cylindrical shell with an internal bore at one end for holding at least one projectile;

a concentric chamber within an opposite end of the cylindrical shell wherein the concentric chamber has a constant internal diameter proceeding toward said internal bore along its full length, smaller than an internal diameter of the internal bore, the concentric chamber opening at its forward end into said internal bore;

a cartridge charged with a pyroxylin powder inserted in the concentric chamber; and, a primer charged with a fulminating compound inserted in the cartridge, wherein the fulminating compound is sufficient to completely ignite the pyroxylin powder.

2. The ammunition according to claim 1, further comprising a cup element fitted in the internal bore, and positioning means within the internal bore for locating the cup element along an axis of the bore.

3. The ammunition according to claim 2, wherein the positioning means is a shoulder.

4. The ammunition according to claim 2, wherein the cup element comprises a skirt for sealing and locating the cup element in the shell bore.

5. The ammunition according to claim 2, wherein the bottom of the cup element is convex.

6. The ammunition according to claim 5, wherein the skirt has a decreasing thickness from an attaching point with the convex bottom to an open end.

7. The ammunition according to claim 2, wherein a front part of the cup element comprises a plurality of slots regularly distributed around a periphery of the cup element.

8. The ammunition according to claim 1, further comprising a plurality of radial fins connecting a periphery of the concentric chamber with the cylindrical shell.

* * * * *